US006531989B1

(12) United States Patent
Barker et al.

(10) Patent No.: US 6,531,989 B1
(45) Date of Patent: Mar. 11, 2003

(54) FAR FIELD EMULATOR FOR ANTENNA CALIBRATION

(75) Inventors: Delmar L. Barker, Tuscon, AZ (US); Harry A. Schmitt, Tucson, AZ (US); David J. Knapp, Tucson, AZ (US); Dennis C. Braunreiter, Oro Valley, AZ (US); Alphonso A. Samuel, Tucson, AZ (US); Steven Schultz, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/992,755

(22) Filed: Nov. 14, 2001

(51) Int. Cl.[7] ..... H01Q 1/42
(52) U.S. Cl. ..... 343/753; 343/703; 343/705
(58) Field of Search ..... 343/753, 705, 343/703, 872, 873, 841; 342/53, 165; 73/856.6, 167

(56) References Cited

U.S. PATENT DOCUMENTS 5,012,250 A * 4/1991 Foley ..... 342/53
5,247,843 A * 9/1993 Bryan ..... 73/865.6
5,973,649 A * 10/1999 Andressen ..... 343/720

* cited by examiner

*Primary Examiner*—Don Wong
*Assistant Examiner*—James Clinger
(74) *Attorney, Agent, or Firm*—Renner, Otto, Boisselle & Sklar, LLP

(57) ABSTRACT

A radar antenna for a guided missile is calibrated in flight using a point source of microwave radiation and a lens to emulate a far field source. The microwave source and lens fit behind a metal cap at the leading end of the radome and so do not adversely affect the radar. A variety of techniques to power the point source are disclosed, and a variety of lens arrangements are disclosed. The invention allows a radar antenna to be calibrated in flight, and so insures against mis-calibration due to aging components as well as the heat and mechanical forces associated with storage and/or launch of the missile.

25 Claims, 1 Drawing Sheet

FAR FIELD EMULATOR FOR ANTENNA CALIBRATION

FIELD OF THE INVENTION

The present invention relates to calibration of a multichannel radar antenna and the associated software, and particularly to calibrating such an antenna and software in a missile in flight.

BACKGROUND OF THE INVENTION

Missiles that use radar as part of their guidance systems generally have a radar antenna in the nose of the missile behind a radome. The radome includes a conical cap which is made of a radar-opaque material, typically metal. The balance of the radome forward of the radar antenna and behind the cap is made of a material transparent to radar.

The radar antenna is calibrated in the course of manufacture and initial setup. Typically, calibration is done in an anechoic chamber with a distant source of microwave radiation of known energy. This source is a far field source, meaning that its wavefronts are essentially parallel to the face of the antenna. The far field source of known energy provides a baseline for calibrating the radar antenna by adjusting variables in the associated software.

The radar antenna generally is arranged in a circular array divided (either physically or logically) into quadrants that meet at the center of the array. Each quadrant forms a separate channel in a multichannel radar antenna. The signals received by each channel of the antenna are transmitted to a processor for processing by software. To calibrate the antenna it is only necessary that a part of each channel of the antenna receive a far field burst of energy. Because the four channels of the antenna meet at the center, the antenna can be calibrated with a far field source that has a relatively small cross-section; covering only a section of each channel is sufficient.

Calibration of a radar antenna may be critical to its proper performance. This is especially true where sophisticated and sensitive software is used to interpret the received signals. For example, software used to distinguish the intended target from various decoys, jamming and/or camouflaging defensive measures associated with the target works better after calibration. Even if accurately calibrated during initial manufacture, the antenna's response to incoming signals can vary over time. For example, after storage of the missile for a long period of time, the antenna can suffer slight physical changes which alter its response. In addition, the very act of launching a missile may subject it to forces and/or temperatures which alter its response.

Because the radar antenna's response can change over time, there is a need for a system and apparatus that can be used to recalibrate a radar antenna in a missile while the missile is in flight.

SUMMARY OF THE INVENTION

The present invention provides a system and apparatus to recalibrate a multichannel radar antenna in a missile by simulating a far field source within the radome of the missile. A point source of radiation is located behind and inside the cap of the radome. Radiation from the point source (which produces spherical wavefronts) passes through a lens that causes the wavefronts to assume a parallel orientation. The parallel waves of radar energy hit the center area of the radar antenna, delivering a pulse of known energy to portions of each channel of the antenna. Based on this input, the software that processes the antenna's signals is recalibrated to compensate for any change in antenna response from the original calibration.

The lens may be any conventional lens such as a lens with continuous concave and/or convex services, a Fresnel lens, a combination of such lenses, or even a diffraction grating. The lens may also utilize the inside surface of the radome as a reflective surface. Further, the lens could be replaced by a parabolic reflector or other device that simulates a lens.

The point source of energy may be a simple dipole antenna. The point source can be driven by an oscillator that can be powered in any of a variety of ways. Power can be fed through wires fastened to the inside of the nose cone or by a fiber-optic cable similarly secured. A laser can transmit energy through free space from the antenna to the oscillator, or the main radar transmitter can be used as an energy source with a capacitor or battery located in the metal cap of the radome to store the energy until it is required to power the oscillator.

BRIEF DESCRIPTION OF THE DRAWINGS

The various features and advantages of the present invention may be more readily understood with reference to the following detailed description taken in conjunction with the accompanying drawings.

DESCRIPTION OF PREFERRED EMBODIMENTS

Figure 1:
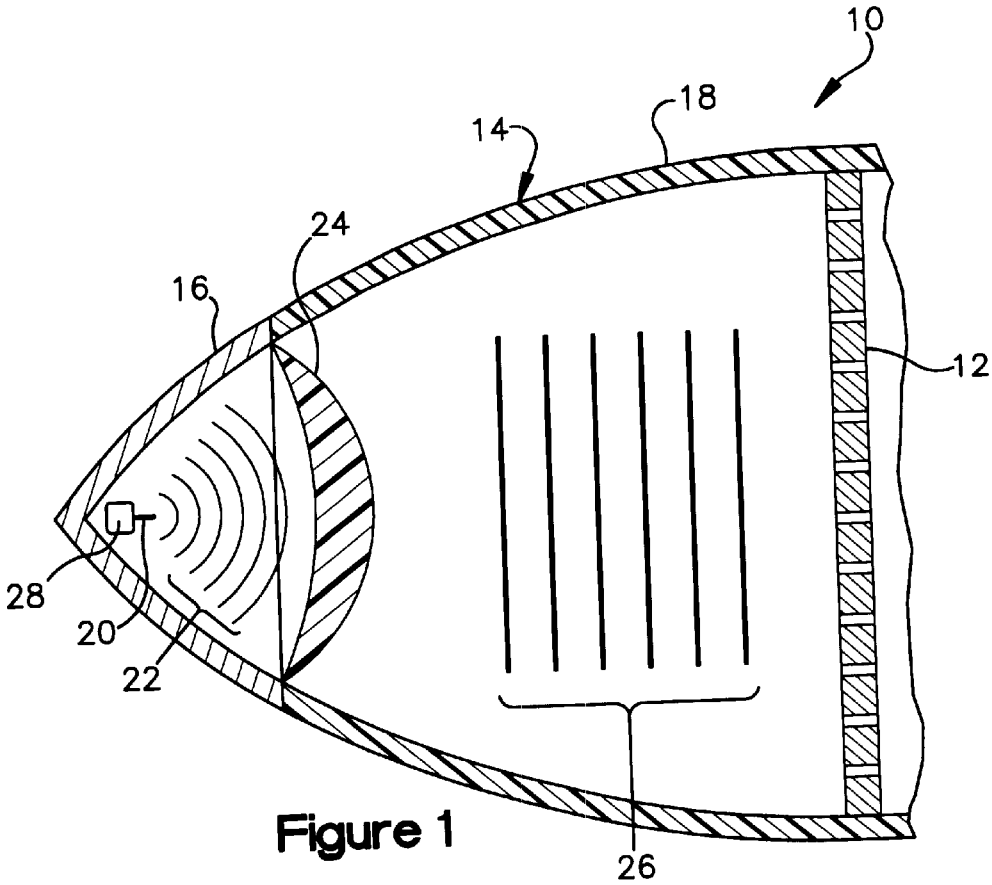
FIG. 1 is a side elevation view, partially in cross-section and showing in schematic form the front portion of a missile, its radar antenna, radome, a point source, and a lens for use in the present invention.

A missile 10 (FIG. 1) includes a radar antenna 12 and a radome 14. The radome 14 has a metal cap 16 and a section 18 transparent to radar frequency electromagnetic radiation (microwave radiation). During flight reflected microwave radiation passes through the transparent section 18 of the radome 14 and is received at the antenna 12. The resulting signals are processed by various computer programs in a processor (not shown) to guide the missile 10 to its intended target. The radome 14, radar antenna 12, and software may be entirely conventional.

At this point, it should be mentioned that in this specification and claims the words "front", "forward", "back", and "behind" are used with reference to the ordinary direction of travel of the missile. Thus, the leading end of the radome 14 during normal flight is the front end of the missile 10, and the radar antenna 12 is behind the radome.

Figure 2:
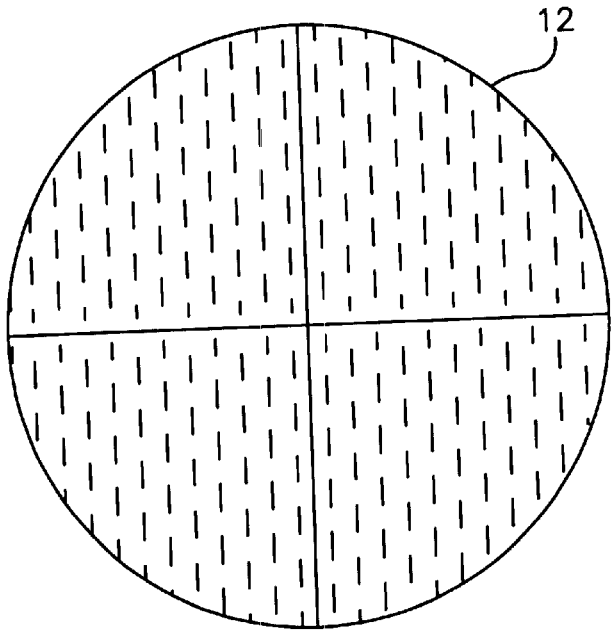
FIG. 2 is a front elevation view of the radar antenna of FIG. 1.

The antenna 12 may include a circular array of waveguides shown schematically in FIG. 2 as a plurality of slits. The exemplary antenna 12 is divided (either physically or logically) into four quadrants that meet at the center of the array. The signals from each waveguide within each quadrant are combined, and the so-combined signal from each quadrant forms a channel of a multichannel antenna. (Other numbers of channels, each formed by a sector of the antenna may also be used.) For various reasons including the passage of time and associated aging of electronic components, as well as exposure to heat and shock or vibration, the antenna 12 may need to be recalibrated in flight. Calibration is accomplished using microwave radiation of a known power from a far field source, i.e., a source with wavefronts that are essentially parallel to the plane of the antenna, so that each illuminated waveguide sees the same input.

The system and apparatus of the present invention may be used to calibrate the antenna 12. To this end, a point source 20 of microwave radiation is located behind the cap 16. Like any point source, the point source 20 emits waves with spherical wavefronts 22. A lens 24 is located between the point source 20 and the antenna 12. The lens 24 is shaped to redirect the microwave radiation emitted by the point source 20 so that it forms parallel, planar waves 26. The antenna 12 is calibrated by causing the point source 20 to emit microwave radiation of a selected frequency for a predetermined amount of time. These waves pass through the lens 24 and provide a known input to the antenna 12. The antenna 12 can then be calibrated by making suitable adjustments to the software that processes the antenna's output.

The point source 20 can be a simple dipole antenna. A dipole, as is well understood in the art, is not truly a point source since it has finite dimensions. Nevertheless, a dipole that has a length that is about one-tenth or less of the diameter of the lens 24 will appear adequately approximate a point source. Alternatively, another emitter of microwave radiation that appears as a point source could also be used and is included within the definition of "point source" as that term is used in this application.

Although a dipole antenna does not emit perfectly symmetrical, i.e., spherical, wavefronts, it does emit microwave radiation in a predictable and repeatable manner that approximates a sphere. Accordingly, the lens 24 may be shaped to compensate for the imperfectly spherical nature of the wavefronts emitted from the point source 20.

The point source 20 is driven by an oscillator circuit 28 located behind the cap 16. The oscillator circuit 28 requires only a few hundred milliwatts of power at the most. The power can be delivered to the oscillator circuit 28 by any of several means. Metal electrical conductors (not shown) can be mounted to the radome to run from a power source (not shown) behind the antenna 12, across the inner face of the transparent section 18 of the radome 14 to the oscillator circuit 28. The wire also could be formed as an integral part of the wall of the radome. The resulting blind spots in the antenna 12 created by the shadows of the metal wires in the radar signal can be compensated for through the signal processing software.

Alternatively, power can be supplied by a fiber optic cable (not shown) similarly mounted on the inside of the radome 14. Such a cable is transparent to microwave radiation, and so there are few if any software adjustments necessary. A third way to power the oscillator circuit 28 is to use a laser (not shown), beaming energy from behind the antenna 12 to a photodiode connected to the oscillator. This technique does not interfere with the antenna or its software. It also does not require a conductor (fiber optic or electric) to be mounted to the radome 14, simplifying construction and increasing reliability. Finally, the point source 20 can be powered by a radar transmitter aboard the missile 10. In this case a brief pulse of this transmitter can supply energy to the oscillator circuit 28 where it is stored in a capacitor or battery until needed. Other techniques for providing power to the oscillator circuit 28 will be apparent to those skilled in the art.

The lens 24 converts spherical wavefronts of the microwave radiation from the point source 20 to plane electromagnetic waves 26, that is, waves that are planar. The lens 24 fits behind the metal cap 16, in its "shadow" and positioned so as not to be in the path of microwave radiation coming through the transparent section 18 of the radome 14 to the antenna 12. Accordingly, the lens 24 has a diameter equal to or less than the maximum diameter of the cap 16.

The lens 24 can be made of any of a variety of materials. Microwave radiation behaves according to the classical laws of electromagnetic radiation, and techniques for designing and manufacturing lenses which bend and shape microwave radiation are well known. The lens 24 can be made, for example, of Teflon, other plastics, wax or paraffin. The lens 24 can be made by polishing and grinding techniques, and it can be cast in a suitably shaped mold.

The lens 24 may be a single, refractive lens with continuously curved surfaces as shown in FIG. 1. However, other lenses are possible and contemplated for use in this invention. For example, a compound lens can be used, i.e., a doublet or triplet, and the lenses may be freestanding or cemented together. The lens may be a Fresnel lens. Moreover, a diffraction grating could also be used. Any known lens may be used so long as it can cause the wavefront emitted by the point source to form waves parallel to the plane of the antenna.

In addition to these more or less conventional lenses, reflective lenses may also be used. For example, the point source could be located at the focus of a parabolic reflector. In this case, the reflector is mounted foremost inside the radome 14 just behind the cap 16, with the point source 20 between the parabolic reflective surface and the antenna 12. A metal screen is used to block waves from the point source directly to the antenna so that only the desired plane waves reflected off of the parabolic reflector reach the antenna. Furthermore, the lens can utilize flat plate lens emulation technology such as that illustrated in U.S. Pat. No. 4,950,014, the entire disclosure of which is incorporated by reference.

Along the same lines, the interior surface of the radome 14 can be shaped to act as a reflector to focus waves with a small angle of incidence into plane wavefronts. This can be done either with a point source alone or with the point source in combination with one or more reflective or refractive lenses.

Thus, it is clear that the present invention provides a system and apparatus for calibrating a radar antenna in a missile in flight. It is to be understood that the described embodiments are merely illustrative of some of the many specific embodiments which represent applications of principles of the present invention. Numerous other arrangements can be readily devised by those skilled in the art without departing from the scope of the invention.

What is claimed is:

1. A device for calibrating a multichannel radar antenna comprising:

a radar antenna, a radome covering the front face of the antenna, a point source of microwave radiation positioned within the radome, and a lens positioned within the radome and shaped to convert the microwave radiation from the point source into plane electromagnetic waves.

2. The device of claim 1 wherein the lens includes a refractive lens.

3. The device of claim 2 wherein the lens includes a single lens.

4. The device of claim 2 wherein the lens includes a compound lens.

5. The device of claim 1 wherein the lens includes a Fresnel lens.

6. The device of claim 1 wherein the lens includes a diffraction grating.

7. The device of claim 1 wherein the lens includes a reflective lens.

8. The device of claim 1 wherein the radome includes a metallic cap, and the point source is positioned behind the cap.

9. The device of claim 8 wherein the lens is positioned behind the cap.

10. The device of claim 9 wherein the cap includes a leading end portion and a maximum diameter behind the leading end portion, and the lens has a diameter equal to or less than the maximum diameter of the cap.

11. The device of claim 1 including an oscillator circuit connected to the point source, and means for supplying power to the oscillator circuit.

12. The device of claim 11 wherein the means for supplying power to the oscillator circuit includes a photo diode connected to the oscillator circuit and means for supplying electromagnetic radiation to the photodiode.

13. The device of claim 12 wherein the means for supplying electromagnetic radiation to the photodiode includes a fiber optic cable.

14. The device of claim 13 wherein the fiber optic cable extends from behind the antenna to the oscillator circuit.

15. The device of claim 12 wherein the means for supplying power to the oscillator circuit includes a laser positioned to transmit laser energy through space from behind the antenna to the photodiode.

16. A method of providing a far field calibration signal to a microwave antenna positioned behind a radome in a missile, comprising the steps of:

energizing a point source of radiation in front of the microwave antenna to cause the point source to emit microwave radiation and forming the emitted radiation into plane electromagnetic waves using a lens.

17. The method of claim 16 including the step of positioning the point source of radiation and the lens inside the radome.

18. The method of claim 17 wherein the step of energizing the point source includes the step of providing power to an oscillator circuit through an electric cable.

19. The method of claim 17 wherein the step of energizing the point source includes the step of providing power to an oscillator circuit through a fiber optic cable.

20. The method of claim 17 wherein the step of energizing the point source includes the step of providing power to an oscillator circuit through free-space laser radiation.

21. The method of claim 16 wherein the step of passing the radiation through a lens includes the step of using a refractive lens.

22. The method of claim 16 wherein the step of passing the radiation through a lens includes the step of using a reflective lens.

23. The method of claim 16 wherein the step of passing the radiation through a lens includes the step of using a Fresnel lens.

24. The method of claim 16 wherein the step of passing the radiation through a lens includes the step of using a compound lens.

25. A device for calibrating a radar antenna with a circular front surface in a missile having a radome with a metal cap at its leading end, the device including a dipole antenna proportioned to emulate a point source of microwave radiation and a lens shaped to convert the radiation emitted from the point source to plane electromagnetic radiation with wave fronts substantially parallel to the front surface of the radar antenna, the dipole and the lens being positioned inside the radome and behind the cap.

* * * * *